US006318237B1

(12) United States Patent
Müller

(10) Patent No.: US 6,318,237 B1
(45) Date of Patent: Nov. 20, 2001

(54) ARRANGEMENT FOR A LOCK CYLINDER FOR A BLOCKING CYLINDER

(76) Inventor: Hans Müller, Pejlingsvägen 6, S-506 70 Frufällan (SE)

( * ) Notice: Subject to any disclaimer, the term of this patent is extended or adjusted under 35 U.S.C. 154(b) by 0 days.

(21) Appl. No.: 09/263,452

(22) Filed: Mar. 5, 1999

(51) Int. Cl.[7] ..... F15B 15/26
(52) U.S. Cl. ..... 92/23; 91/41
(58) Field of Search ..... 92/23, 24, 26; 91/44, 41, 45

(56) References Cited

U.S. PATENT DOCUMENTS 2,764,132 * 9/1956 Bakke ..... 92/25
4,050,674 * 9/1977 Robbins et al. ..... 254/93

* cited by examiner

*Primary Examiner*—Edward K. Look
*Assistant Examiner*—Thomas E. Lazo

(74) *Attorney, Agent, or Firm*—Orum & Roth

(57) ABSTRACT

The invention relates to an arrangement for a fluid-driven lock cylinder for the actuation of moving parts such as slides, cores and corresponding units on press tools and injection moulding tools for metal or plastic materials.

A piston is accommodated in a displaceable fashion in a piston cylinder.

A divided ring forms an end stop for the piston.

The stop ring exhibits a maximum diameter which exceeds the diameter of the piston.

An inclined external axial part of the stop ring forms a stop for making contact with a counter-pressure part of the piston cylinder.

The counter-pressure part is inclined to a degree corresponding to the inclination of the end stop on the stop ring.

6 Claims, 5 Drawing Sheets

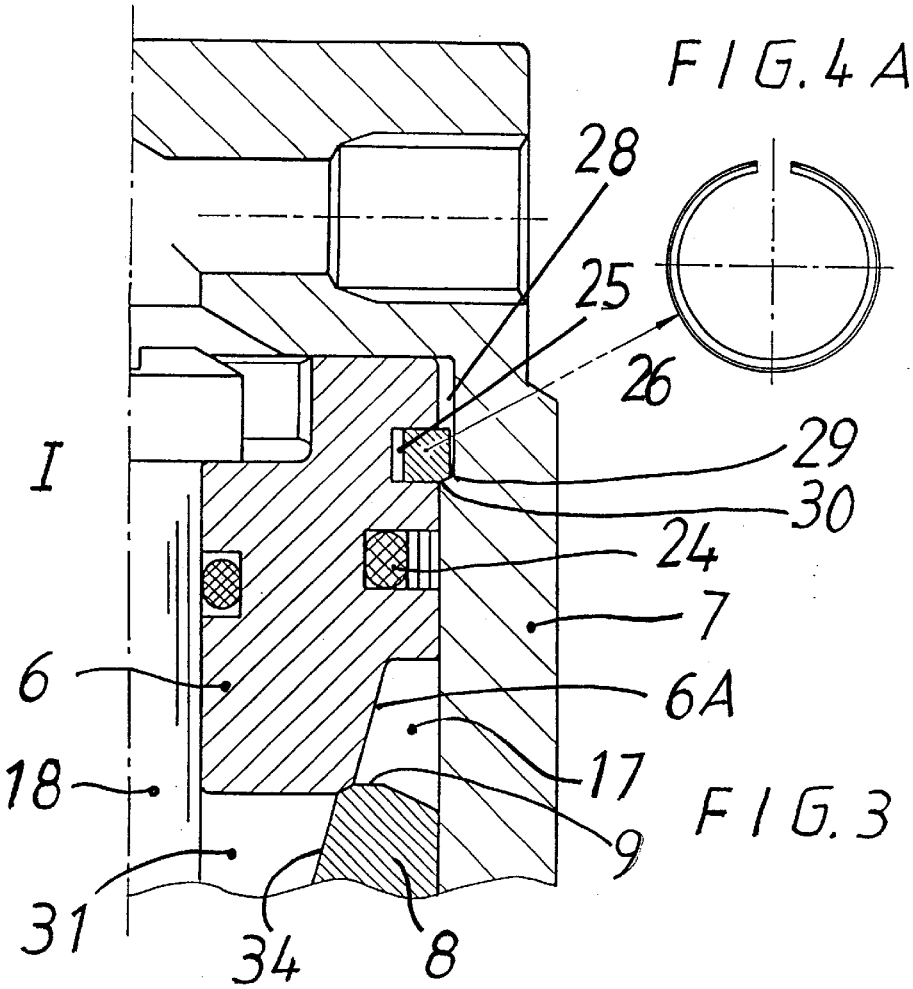
FIG. 3
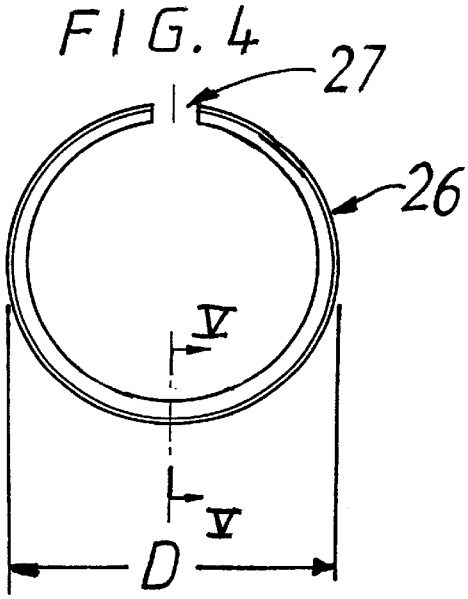
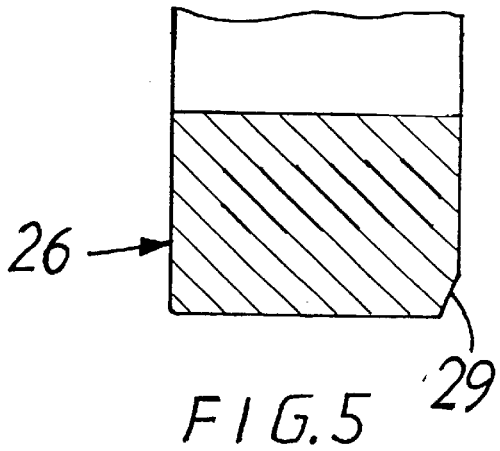
FIG. 5

ARRANGEMENT FOR A LOCK CYLINDER FOR A BLOCKING CYLINDER

The present invention relates to an arrangement for a fluid-driven lock cylinder for the actuation of moving parts such as slides, cores and corresponding units on press tools and injection moulding tools for metal or plastic materials, comprising a piston accommodated in a displaceable fashion in a piston cylinder, in conjunction with which a divided ring forms an end stop for the piston.

Previously disclosed arrangements of the aforementioned kind cannot be manufactured and installed in a simple fashion so as to function in an effective and safe manner.

The principal object of the present invention is thus, in the first instance, to solve said problem by simple and efficiently functioning means.

Said object is achieved by means of an arrangement in accordance with the present invention, which is characterized essentially in that the stop ring exhibits a maximum diameter which exceeds the diameter of the piston, and in that an inclined outer axial part of the stop ring forms a stop for making contact with a counter-pressure part of the piston cylinder, in conjunction with which the counter-pressure part is inclined to a degree corresponding to the inclination of the end stop on the stop ring.

The invention is described below as a number of preferred illustrative embodiments, in conjunction with which reference is made to the accompanying drawings, in which FIG. 1 shows an illustrative assembly of the lock cylinder assembly;

FIG. 3 shows a sectioned view of the end part of a cylinder with the piston's locking ring accommodated therein;

FIGS. 4 and 4A show the locking ring outside the piston;

FIG. 5 shows a sectioned view along the line V—V in FIG. 4;

Figure 1:
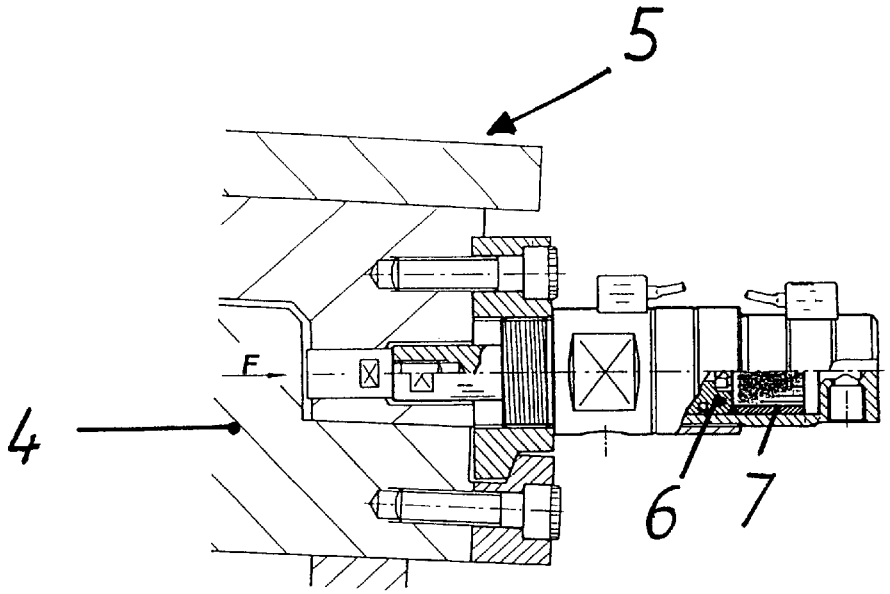
Figure 2:
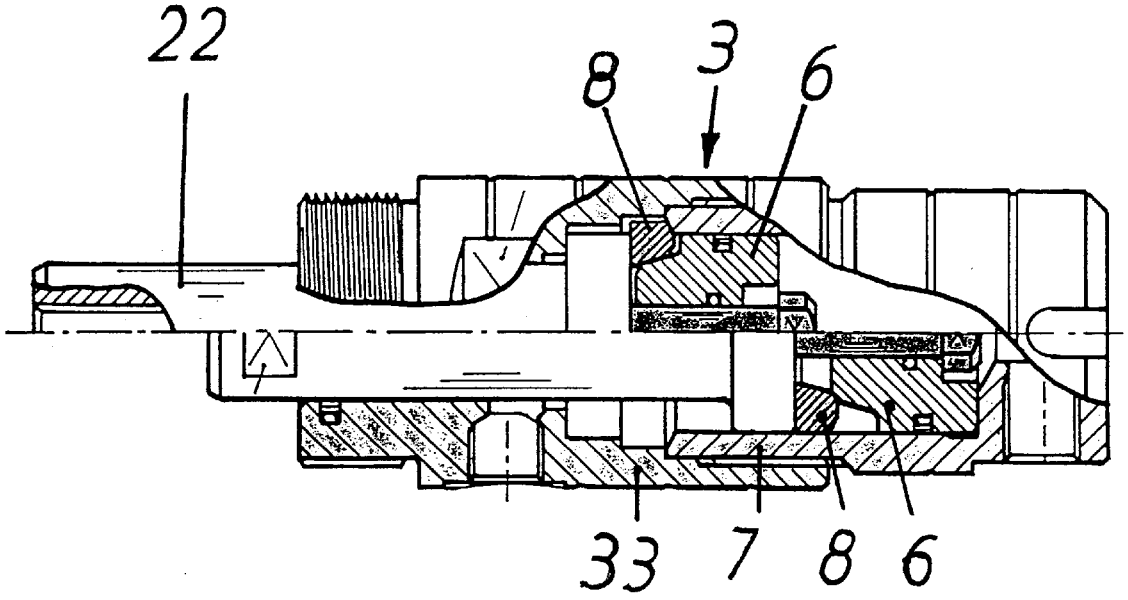
FIG. 2 shows a partially sectioned view of the cylinder in a position inserted to its maximum extent and in an extended position.

An arrangement 1 for a lock cylinder 3 driven by a fluid such as oil 2 or air $\mathbf{2}^1$, for the actuation of moving parts 4 such as slides, cores and a corresponding unit on a press tool or an injection moulding tool 5 for metal or plastic materials, comprises a piston 6 accommodated in a displaceable fashion in a piston cylinder 7. In conjunction with this, a ring 8 forms an end stop for the piston 6.

In accordance with the invention, said stop ring 8 exhibits a maximum diameter D which exceeds the diameter d of the piston 6. An inclined external axial part 9 of the stop ring 8 forms a stop for making contact with an inclined counter-pressure part 10 of the piston cylinder 7. The counter-pressure part 10 is inclined in this case to a degree corresponding to the inclination of the end stop 9 on the stop ring 8.

Figure 6:
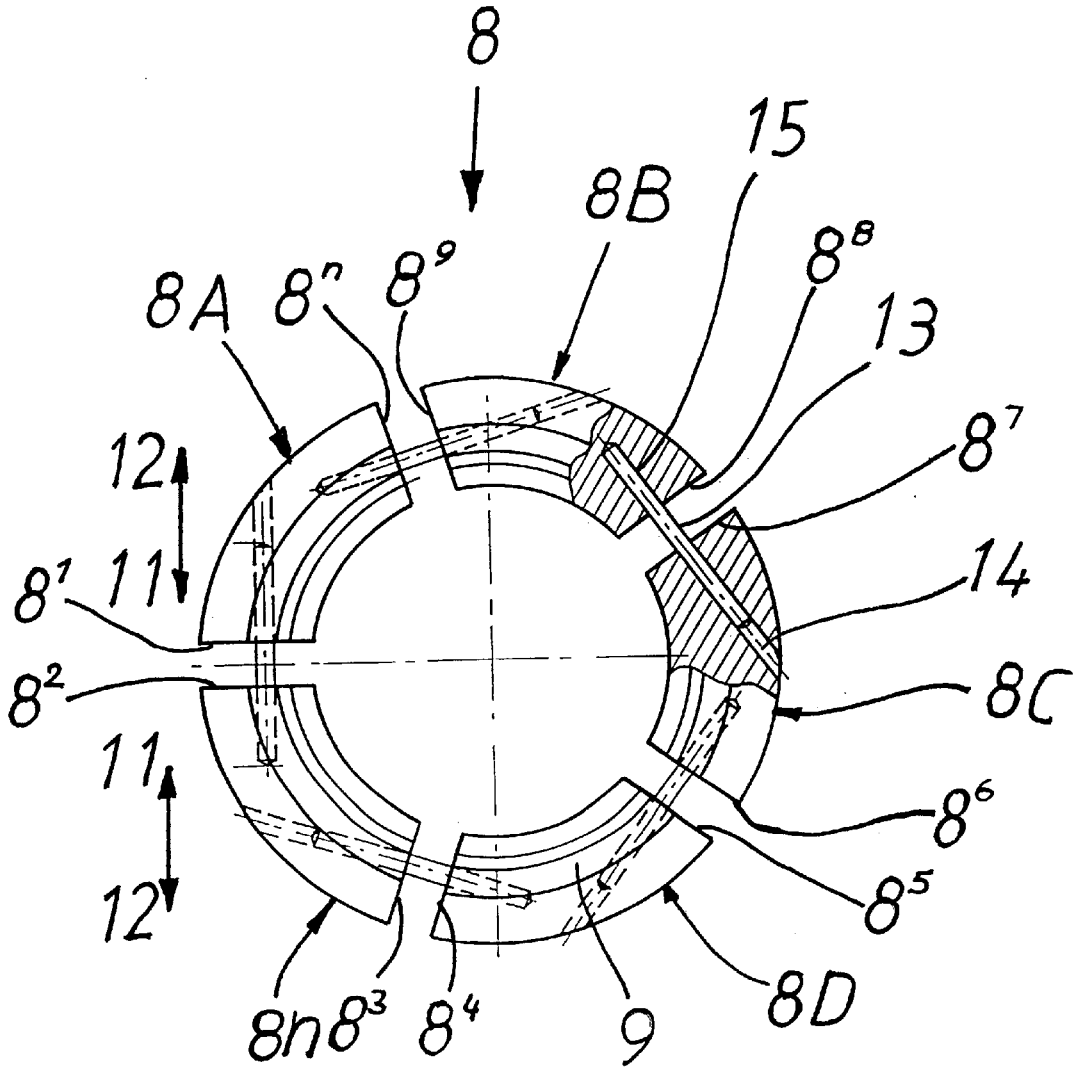
FIG. 6 shows a partially sectioned view of a stop ring for the piston in a separated, widened position.

Said ring 8 is formed by at least two, but preferably more segment-forming ring parts 8A, 8B . . . 8*n*, for example five pieces as in the present example. Said ring parts 8A–8*n* are held together at mutually touching end parts $\mathbf{8}^1, \mathbf{8}^2 \ldots \mathbf{8}^n$ and are guided in a direction towards 11 and away from 12 one another by means of a guide pin 13. Said guide pin 13 is accommodated in tangential holes 14, 15 which extend through pairs of ring parts, for example 8B, 8C, as illustrated in FIG. 6. In this case, one of the holes 14, 15 is a so-called bottom hole 15, while the other of the pair of holes 14, 15 is a transcurrent hole 14.

The ring 8 is so arranged as to be accommodated in a ring-shaped groove 17 formed in the piston 6.

The piston 6 is appropriately divided at its free end 6B and exhibits a projecting stroke-limiting end part 19 capable of being secured with a central screw 18, which end part is so arranged as to make the piston 6 higher in order to strike the top 20 of the cylinder 7 earlier.

Said securing screw 18 is accommodated in a central hole 21, which also extends into a piston rod 22.

The piston 6 accommodates an o-ring seal 24 in a ring-shaped groove 23, and a means 26 for checking self-actuation in the form of a sprung, ring-shaped, divided 27 check ring 26 is accommodated in an externally situated ring-shaped groove 25. Said check ring 26 is so arranged as to be capable of springing apart and being accommodated in a wider ring-shaped accommodating part 28 of the piston cylinder 7.

Present here is an inclined part 29, 30 of both the check ring 26 and the accommodating part 28, enabling them to interact and pass down into the internal space 31 of the piston cylinder. This check ring 26 prevents the piston 6 from moving unintentionally in its outer position I, as illustrated in FIG. 3.

Figure 7:
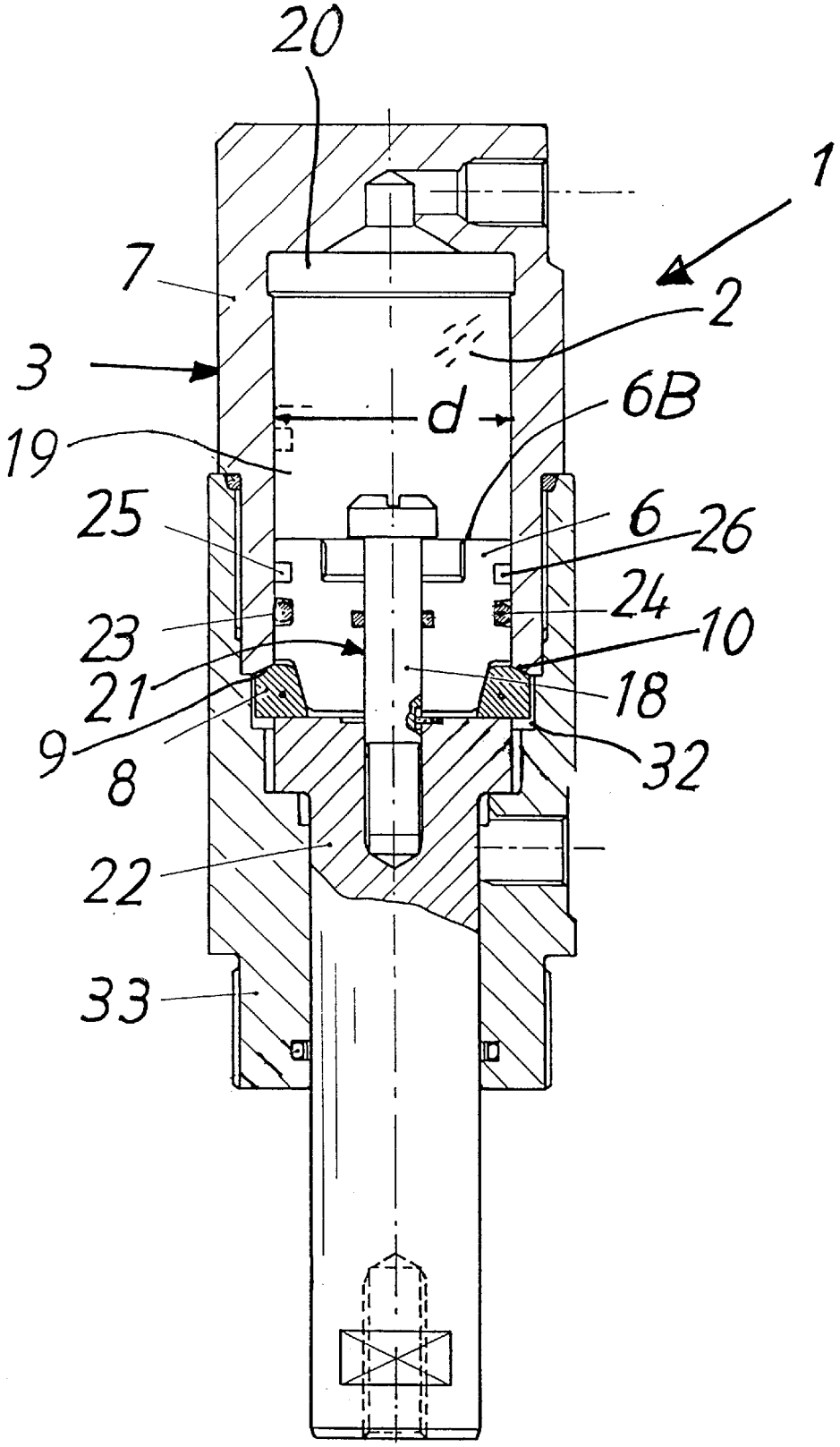
FIG. 7 shows a sectioned view of a lock cylinder intended for oil.

The piston 6 exhibits an inclined part 6A for the purpose of forming said ring-shaped groove 17 therein, together with a wider space 32 in a cylinder housing 33 accommodating said piston cylinder 7; see FIG. 7.

The stop ring 8 exhibits an internally conical hole 34, in which said conical part 6A of the piston 6 can be accommodated.

Finally, the inclined external axial counter-pressure part 10 is formed by the end edge of a part 7 of the composite piston cylinder 3.

Figure 8:
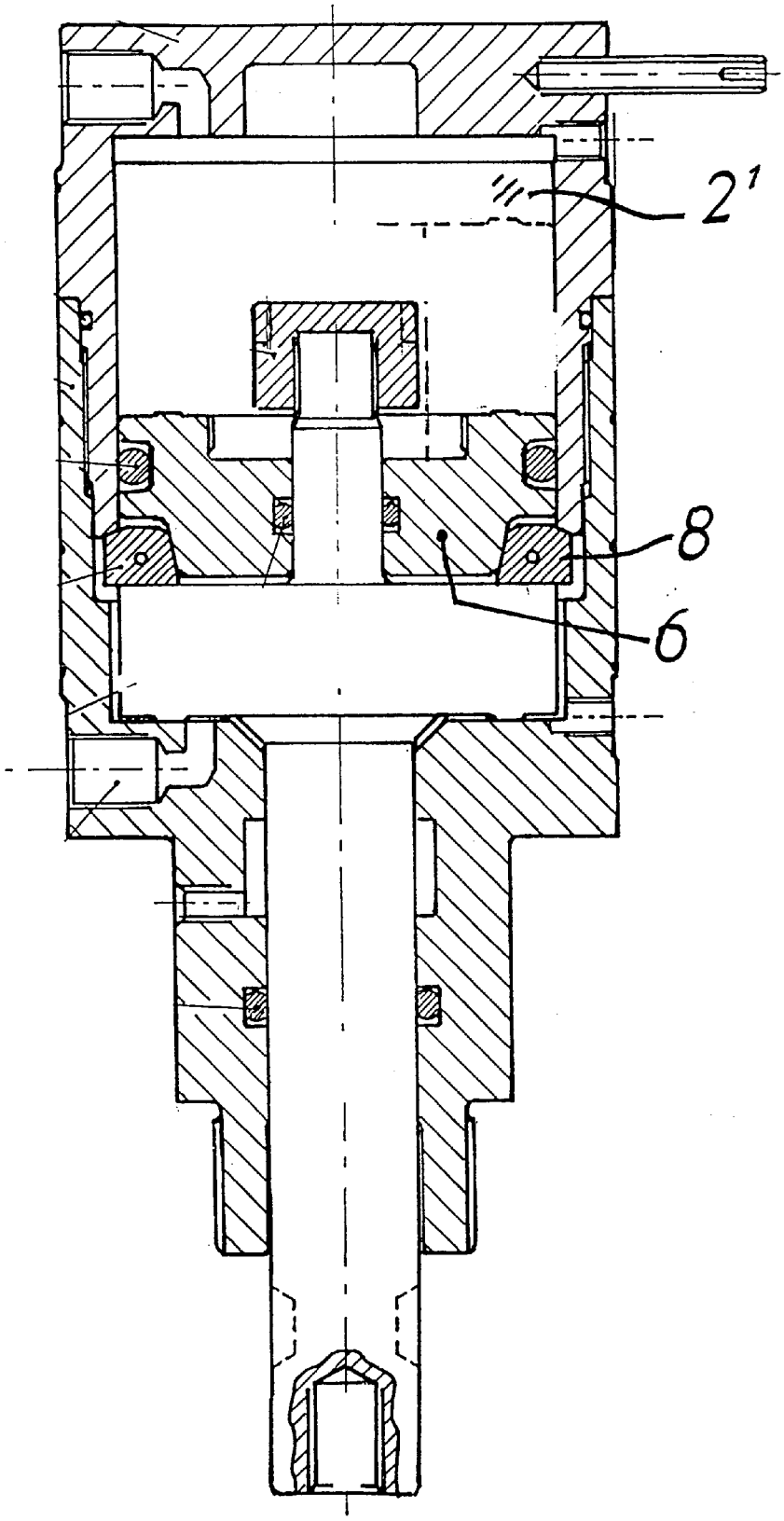
FIG. 8 shows a sectioned view of a lock cylinder intended for air.

The function of the lock cylinder illustrated by way of example in FIGS. 7 and 8 remains the same, regardless of the driving fluid 2, $\mathbf{2}^1$, which is supplied to either side of the piston 6, and resembles that of conventional piston cylinders.

What is claimed is:

1. Arrangement (1) for a fluid-driven (2, $\mathbf{2}^1$) lock cylinder (3) for the actuation of moving parts (4) such as slides, cores and corresponding units on press tools and injection moulding tools (5) for metal or plastic materials, comprising:

a piston (6) accommodated in a displaceable fashion in a piston cylinder (7), in conjunction with which a divided ring (8) forms an end stop for the piston (6), characterized in that the stop ring (8) exhibits a maximum diameter (D), which exceeds the diameter (d) of the piston (6), and in that an inclined external axial part (9) of the stop ring (8) forms a stop for making contact with a counter-pressure part (10) of the piston cylinder (7), in conjunction with which the counter-pressure part (10) is inclined to a degree corresponding to the inclination of the end stop (9) on the stop ring (8); the ring (8) is formed by at least two segment-forming ring parts (8A, 8B), which are held together at mutually touching end parts (8A–8$^n$) and are guided in a direction towards (11) and away from (12) one another by means of a guide pin (13).

2. Arrangement as claimed in Patent claim 1, characterized in that the guide pin (13) is accommodated in tangential holes (14, 15), which extend through pairs of ring parts (8A, 8B, 8B, 8C, 8C, 8D, 8D–8*n*) at their mutually touching ends (8$^1$–8$^n$).

3. Arrangement as claimed in one or other of Patent claims 1–2, characterized in that the ring (8) is accommodated in a ring-shaped groove (17) formed in the piston (6).

4. Arrangement as claimed in Patent claim 1, characterized in that the piston (6) is divided at its free end (6B) and exhibits a stroke-limiting end part (19) that can be screwed on.

5. Arrangement as claimed in Patent claim 4, characterized in that the end part (19) exhibits a central hole (21) which accommodates a fixing screw (18).

6. Arrangement as claimed in Patent claim 1, characterized in that the stop ring (8) exhibits an internally conical hole (34), in which a part (6A) of the piston (6) is accommodated.

* * * * *